United States Patent [19]

Dropczynski

[11] Patent Number: 5,012,987

[45] Date of Patent: May 7, 1991

[54] DRUM-TYPE WINDER FOR WINDING A WEB OF MATERIAL, ESPECIALLY A WEB OF PAPER OR CARDBOARD, ON CORES

[76] Inventor: Hartmut Dropczynski, Wilhelm Busch-Str. 100, 4047 Dormagen, Fed. Rep. of Germany

[21] Appl. No.: 310,402

[22] Filed: Feb. 13, 1989

[30] Foreign Application Priority Data

Feb. 12, 1988 [DE] Fed. Rep. of Germany ..... 3804402

[51] Int. Cl.[5] ..... B65H 19/22

[52] U.S. Cl. ..... 242/56 R; 242/66

[58] Field of Search ..... 242/56 R, 65, 66

[56] References Cited

U.S. PATENT DOCUMENTS 4,601,441 7/1986 Oinonen et al. ..... 242/56 R
4,609,162 9/1986 Kataoka ..... 242/56 R
4,789,109 12/1988 Kyytsonen et al. ..... 242/56 R

FOREIGN PATENT DOCUMENTS 2930474 10/1980 Fed. Rep. of Germany .
3151256 10/1983 Fed. Rep. of Germany .

*Primary Examiner*—Stuart S. Levy
*Assistant Examiner*—Steven M. duBois

[57] ABSTRACT

A drum-type winder for winding a web of material, especially a web of paper or cardboard, on cores, including a mechanism for inserting a fresh core in the drum valley and for separating the web, a structure that accommodates the core, and a mechanism that separates the web. The accommodating structure and the web separator are secured to a double-articulation arm that pivots parallel to the axis of the drum. The accommodation is secured to the free section of the arm and the free section has an extension that projects beyond the core accommodation and to which the web-separating mechanism is secured.

3 Claims, 5 Drawing Sheets

DRUM-TYPE WINDER FOR WINDING A WEB OF MATERIAL, ESPECIALLY A WEB OF PAPER OR CARDBOARD, ON CORES

BACKGROUND OF THE INVENTION

The invention relates to a drum-type winder for winding a web of material, especially a web of paper or cardboard, on cores, with a mechanism for inserting a fresh core in the drum valley and for separating the web, whereby a structure that accommodates the core and a mechanism that separates the web are secured to a double-articulation arm that pivots parallel to the axis of a drum.

Drum-type winders are employed in particular to wind webs of paper or cardboard deriving from a supply reel into smaller individual reels, whereby the web from the supply reel is simultaneously slit longitudinally into individual webs. They have two or more drums, and the reels are wound axially adjacent onto cores in the valley between two drums. Once the reels have attained the desired diameter, the longitudinally slit individual webs arriving from the supply reel are separated, the finished reels are unloaded, fresh cores are inserted into the valley, and the newly established initial sections of individual web are wound onto the cores.

A drum-type winder of this general type is known from German AS 2 930 474. It has a perforating rail fastened to a shell segment secured between two bucklers. The shell segment pivots around an eccentric axis that parallels the axis of the drum. Pivoting on the bucklers are arms that support between themselves a trough-shaped accommodation for a fresh core. The arms, and accordingly the trough with the fresh core, can be pivoted in relation to the bucklers until the trough arrives above the nip between the two drums. The web separates by tearing against the perforating structure when the finished reel is ejected from the drum valley. A fresh core is inserted in the valley while the newly established initial web section is secured to the drum.

The drawback to this winder is that the point at which the web is separated cannot be varied. It has been demonstrated that problems in fastening the newly established initial web section to the fresh core can occur when the cores differ in diameter if the length of the initial web section up to the line where the core contacts the drum is not appropriate to the particular core diameter. If the core has a long diameter, the length of the initial web section between the line of separation and the line of contact between the core and the drum must be greater than if the core has a shorter diameter.

One method of adapting the position of the line of separation to cores of different diameter is known from German Patent 3 151 256. That winder has a pivoting subassembly consisting of a stapling and cutting mechanism that travels across the axis of the drum. This solution, however, necessitates a separate pivoting mechanism to insert a fresh core.

OBJECT OF THE INVENTION

The object of the present invention is to provide a drum-type winder of the aforesaid general type and with a core accommodation and a web-separating mechanism secured to a common double-articulation arm, whereby the position of the line where the web is separated can be varied by simple means in relation to the diameter of the core.

This object is attained in that the accommodation is secured to the free section of the arm and the free section has an extension that projects beyond the core accommodation and to which the web-separating mechanism is secured.

The winder can have a mechanism that pivots the free section of the arm against an in-pivoting arm.

The winder can also have a continuously variable stop that limits the motion of the free section of the arm against the in-pivoting arm.

Furthermore, the winder can have a core accommodation in the form of a channel secured to the free section of the arm.

Finally, the winder can have a web-separating knife that travels along a guide rail extending over the operating width.

BRIEF DESCRIPTION OF THE DRAWINGS

The invention will now be specified with reference to the drawings, wherein.

DETAILED DESCRIPTION OF THE INVENTION

Figure 1:
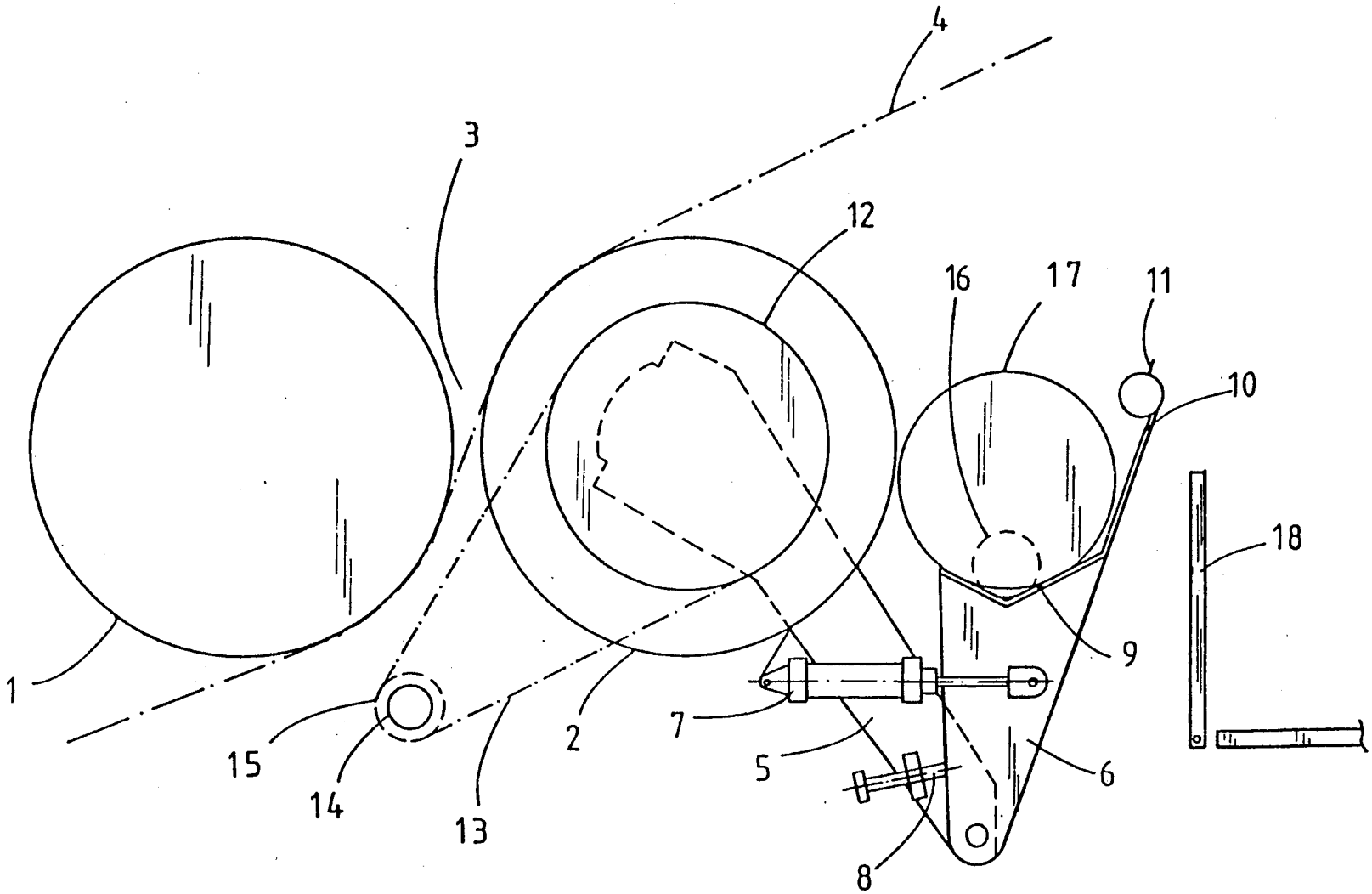
FIG. 1 is a simplified illustration of a winder in accordance with the invention with the core accommodation in the loading position.
Figure 2:
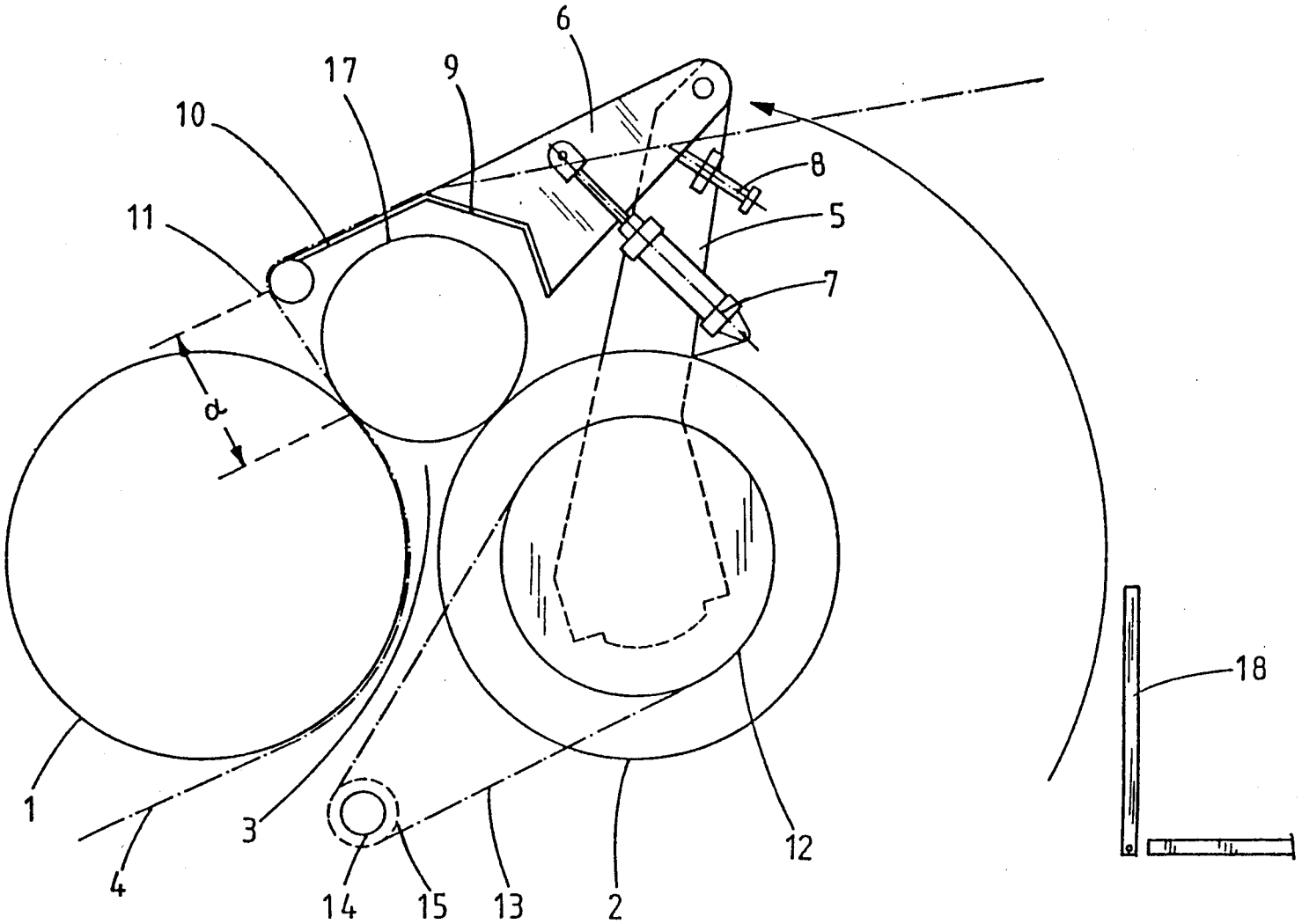
FIG. 2 illustrates the winder at the core-insertion and web-separation stage as adjusted for cores with a long diameter.

A drum-type winder has two drums 1 and 2 separated by a valley 3, in which the reels rest, while they are being wound, against the drums. A web 4 of material, preferably a web of paper or cardboard, is deflected up by drum 1 between the nip between drums 1 and 2 and into valley 3. Since two-drum winders of this type are in themselves known, the details of their design will not be discussed herein.

At each end of drum 2 and within the frame of the winder, an in-pivoting arm 5 pivots around an axis that parallels the axis of the drums. The axis of the arm in the particular embodiment illustrated coincides with the axis around which drum 2 rotates. Articulated to the other end of each in-pivoting arm 5 is another arm 6 that can be pivoted toward in-pivoting arm 5 by a piston-and-cylinder mechanism 7 situated between them. The length of the pivoting motion is limited by adjustable stops 8. At the free end of each pivoting arm 6, a core channel 9 that extends across the operating width of the winder is secured in a matching recess. The section of the free end of each pivoting arm 6 that points away from drum 2 has an extension 10. Secured to the end of each extension 10 is a hollow cylinder that extends across the operating width of the winder and guides a web-separating knife 11 that travels parallel to the axis of the drum. Extensions 10 project more or less into the vicinity of the apical line of a core with a maximal diameter resting in channel 9.

The motion of in-pivoting arms 5 is generated by chain wheels 12 mounted with their axes coinciding with that of the arms. The chain wheels are driven by way of chains 13 by a live rotating shaft 14 that extends across the operating width of the winder and has associated chain wheels 15 at each end. Shaft 14 also makes it possible to synchronize the in-pivoting motion at each end of drum 2.

The newly established initial web section can be manually secured to fresh cores 16 and 17 from a pivoting access platform 18 next to the winder.

How fresh cores 16 and 17 are inserted and how web 4 is separated will now be specified with reference to FIGS. 1 through 5.

FIG. 1 represents the loading stage, during which either cores 16 with a short diameter or cores 17 with a long diameter can be inserted manually or automatically in channel 9. In-pivoting arms 5 slope down at approximately 45° and pivoting arms 6 are approximately upright due to the complete emergence of the cylinder in mechanism 7. The finished reels have been ejected from valley 3 and rest on an unillustrated halfway descended descending stage. Web 4 has not as yet been separated and is accordingly tensioned between the finished reels and the supply reel. The edge of axially moving separating knife 11 is at rest outside the vicinity of web 4 and access platform 18 is up.

Figure 3:
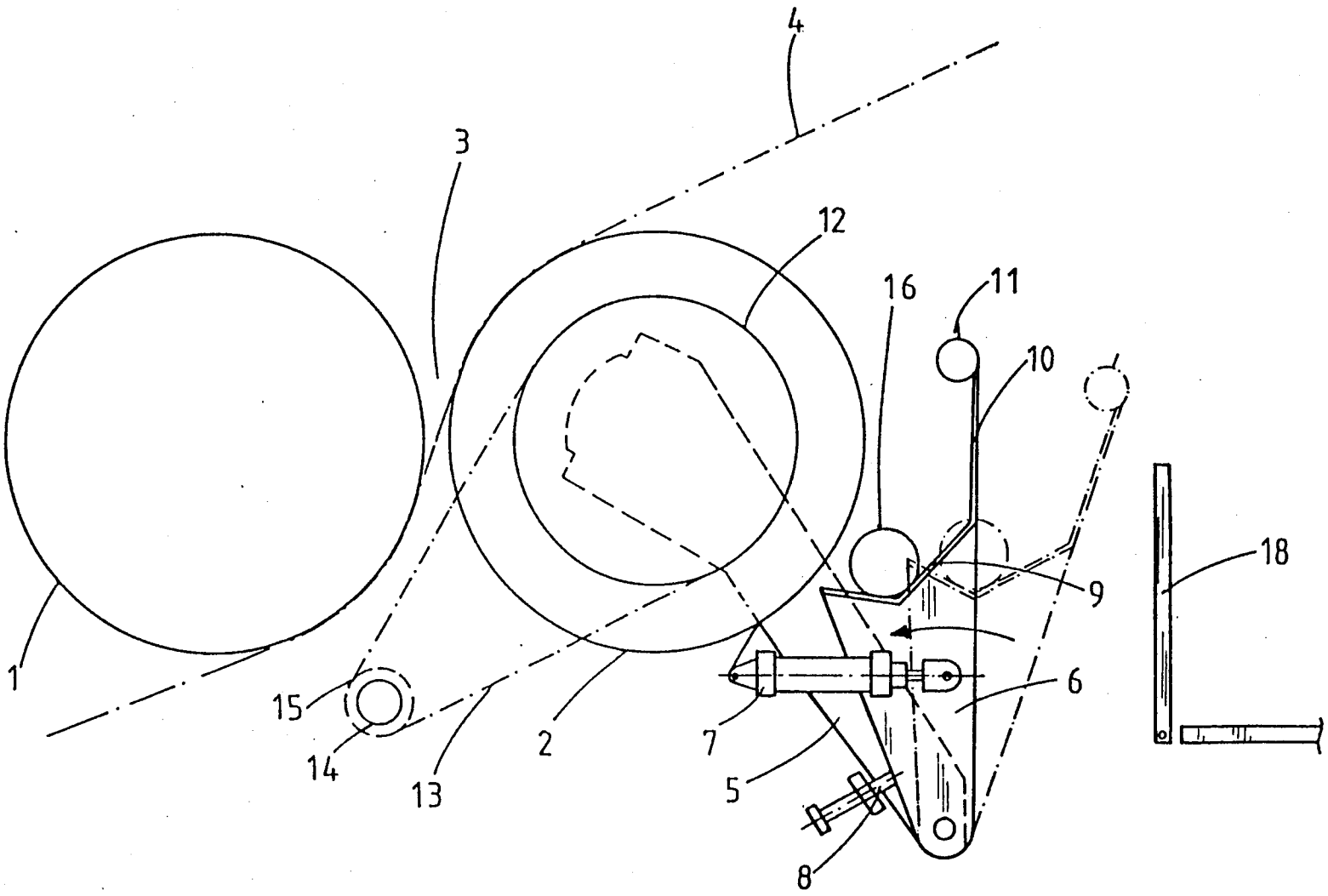
FIG. 3 illustrates the position of the core accommodation in relation to the in-pivoting arm before the arm pivots into the drum valley in a winder adjusted for cores with a short diameter.

Once cores 16 or 17 have been inserted in channel 9, piston-and-cylinder mechanism 7 pivots arms 6 toward in-pivoting arms 5, with the motion limited by stops 8. Said motion will be minimal for cores 17 with a long diameter and more extensive for cores 16 with a short diameter (FIG. 3).

Figure 4:
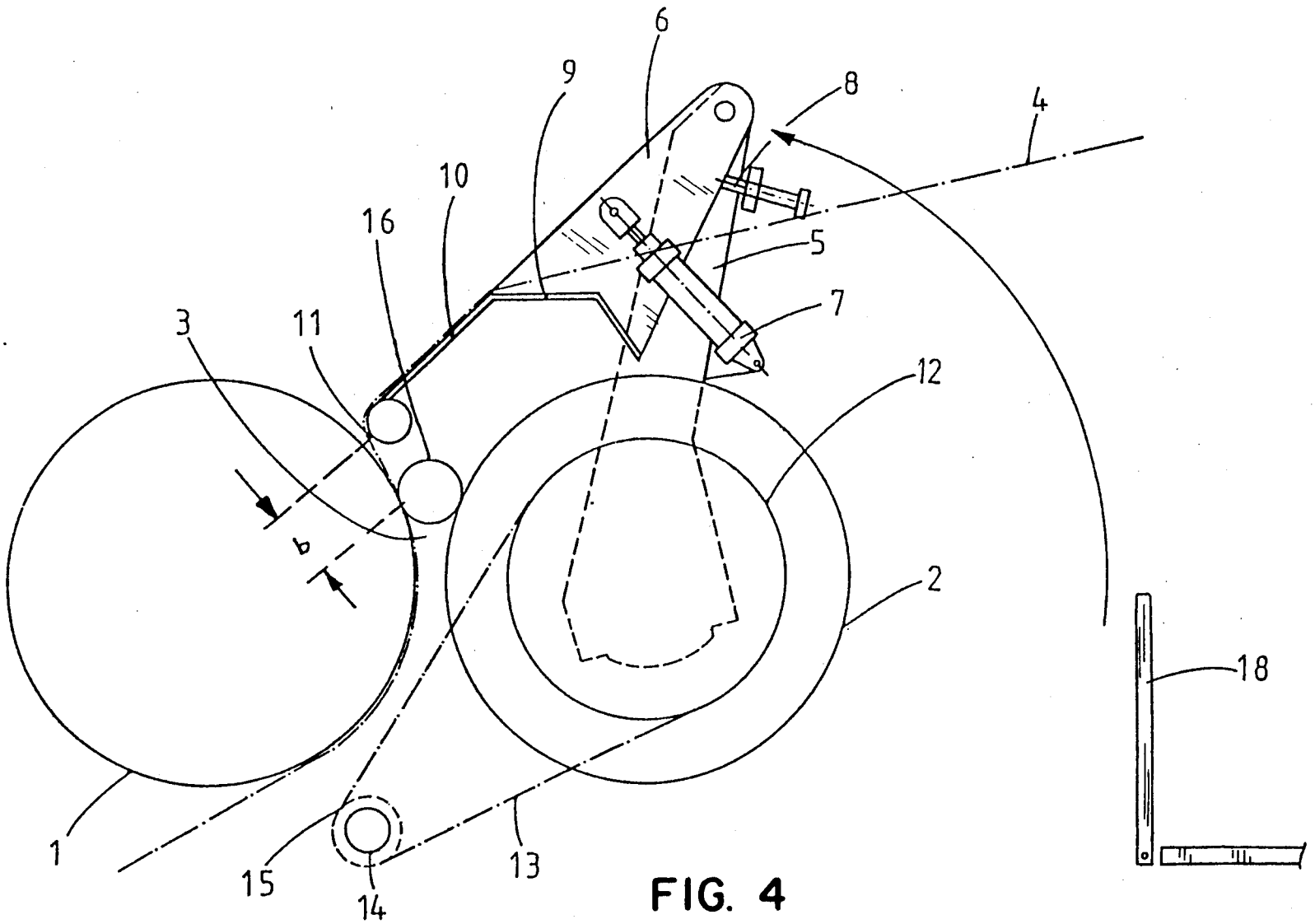
FIG. 4 illustrates the core-insertion and web-separating stage in a winder adjusted for cores with a short diameter.

Arms 5 are then pivoted in counterclockwise toward valley 3 by drive mechanisms 12 through 15. As the pivoting motion commences, cores 16 or 17 will roll along the slope of channel 9 toward drum 2, entrained by the section of channel 9 adjacent to the drum. Once the guide cylinder arrives at web 4, it begins to force it with an increasing pivoting motion toward drum 1, creating enough space between web 4 and drum 2 to allow cores 16 or 17 to continue rolling toward and eventually into valley 3, at which point they will be resting against both drums 1 and 2. At this point the pivoting-in motion is discontinued (FIGS. 2 & 4) and separating knife 11 is driven across web 4 and over the total operating width, separating the tensioned web 4. As will be evident from FIGS. 2 and 4, the length of the accordingly newly established initial web section a or b will be dictated by the previously adjusted angle between in-pivoting arms 5 and pivoting arms 6. For long-diameter cores 17 (FIG. 2), the distance a between the cutting position of separating knife 11 and the line of contact between core 17 and valley 3 will be longer than the corresponding length b for short-diameter cores 16 (FIG. 4).

Figure 5:
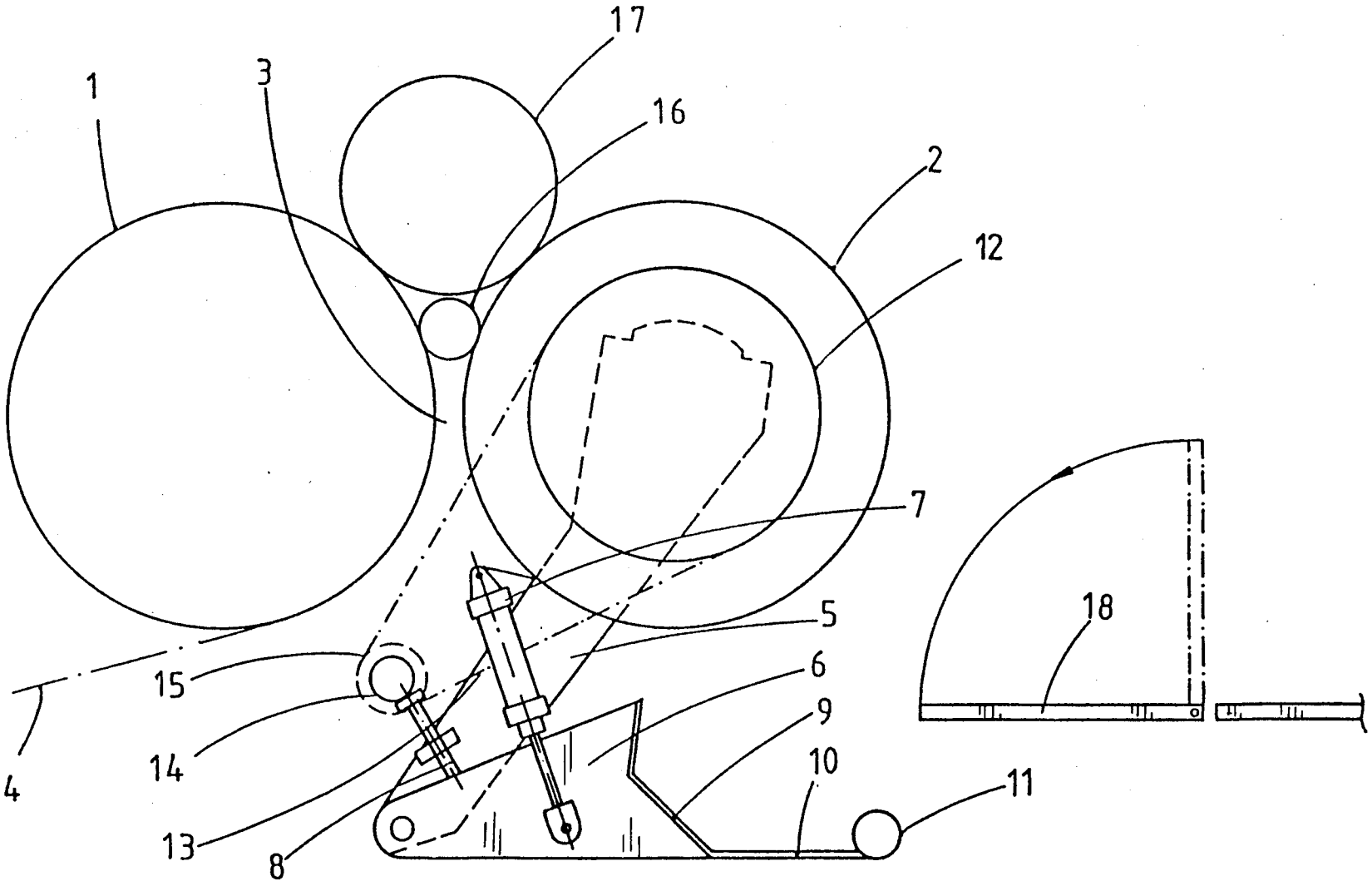
FIG. 5 illustrates the core-insertion and web-separating mechanism while a reel is being wound.

Once web 4 has been separated, all of the mechanisms will be pivoted back down to the rest position illustrated in FIG. 5. Access platform 18 is then pivoted horizontal so that the newly established initial web sections can be secured to the fresh cores. The securing procedure is facilitated in that each newly established initial web section is adapted to the particular core diameter.

It is understood that the specification and examples are illustrative but not limitative of the present invention and that other embodiments within the spirit and scope of the invention will suggest themselves to those skilled in the art.

What is claimed is:

1. In a two drum-type winder for winding a web of material onto a core after looping partially around one of the drums, comprising means for inserting a fresh core in the drum valley, means for separating the web, a structure that accommodates the core, and a double-articulation arm that pivots about an axis parallel to the axes of the drums, the double-articulation arm being connected to the structure that accommodates the core and to the means for separating the web, the structure that accommodates the core being secured to a free section of the arm and the free section has an extension that projects beyond the core accommodation, to which extension the web-separating mechanism is connected, the improvement which comprises a mechanism that pivots the free section of the arm against an in-pivoting arm, and a continuously variable stop that limits the motion of the free section of the arm against the in-pivoting arm, the stop being attached to both arms proximate the pivot joint, the accommodating mechanism and the web-separating mechanism pivoting toward the bed around the unlooped drum, whereby the winder is capable of accommodating cores of various diameters and of pivoting through different arcs.

2. A winder according to claim 1, wherein the core accommodation is in the form of a channel secured to the free section of the arm.

3. A winder according to claim 1, wherein the web-separating means comprises a knife that travels along a guide rail extending over the operating width.

* * * * *